US005544451A

United States Patent [19]

Cheng et al.

[11] Patent Number: 5,544,451

[45] Date of Patent: Aug. 13, 1996

[54] VIBRATION SUPPRESSION DEVICE FOR A STRUCTURE

[75] Inventors: Chao-hsi Cheng; Yuan-jyi Lee, both of Taichung Hsien, Taiwan

[73] Assignee: Taichung Machinery Works, Co., Ltd., Taichung, Taiwan

[21] Appl. No.: 520,196

[22] Filed: Aug. 28, 1995

[51] Int. Cl.[6] ..... E04H 9/02; E04B 1/98

[52] U.S. Cl. ..... 52/167.2; 52/1

[58] Field of Search ..... 52/167.1, 167.2, 52/1

[56] References Cited

U.S. PATENT DOCUMENTS 4,841,685 6/1989 Masri et al. ..... 52/1
5,005,326 4/1991 Ishimaru et al. ..... 52/1 X
5,265,387 11/1993 Ishimaru et al. ..... 52/167.1
5,347,772 9/1994 Ishimaru et al. ..... 52/1 X

*Primary Examiner*—Carl D. Friedman
*Assistant Examiner*—Yvonne Horton-Richardson
*Attorney, Agent, or Firm*—Townsend and Townsend and Crew

[57] ABSTRACT

A vibration suppression device includes a plurality of first elongated linear guides on which a first support table is slidably mounted. A first adjustable damping system is provided for damping slidable movement of the first support table on the plurality of first elongated linear guides. A plurality of second elongated linear guides are fixedly mounted on a top face of the first table and arranged perpendicular to the plurality of first elongated linear guides. A second support table is slidably mounted on the plurality of second elongated linear guides. A second adjustable damping system is provided for damping slidable movement of the second support table on the plurality of second elongated linear guides.

3 Claims, 9 Drawing Sheets

VIBRATION SUPPRESSION DEVICE FOR A STRUCTURE

BACKGROUND OF THE INVENTION

1. Field of the Invention

The present invention relates to a vibration suppression device, and more particularly to a vibration suppression device for a high-rise structure.

2. Related Prior Art

A conventional vibration suppression device for a structure is shown in FIGS. 7 and 8. However, there are still some shortcomings and drawbacks in the conventional vibration suppression device.

There will be a complete illustration in the detailed description of the preferred embodiments, concerning the conventional vibration suppression device.

The present invention has arisen to mitigate and/or obviate disadvantages of the conventional vibration suppression device.

SUMMARY OF THE INVENTION

In accordance with one aspect of the present invention, there is provided a vibration suppression device comprising a plurality of first elongated tracks fixedly mounted on a top face of a structure and arranged in parallel with each other. A first support table is slidably mounted on the plurality of first elongated tracks. A first adjustable damping system is pivotally mounted between the plurality of first elongated tracks and the first support table for damping slidable movement of the first support table on the plurality of first elongated tracks.

A plurality of second elongated tracks are fixedly mounted on a top face of the first table and are arranged in parallel with each other and perpendicular to the plurality of first elongated tracks. A second support table is slidably mounted on the plurality of second elongated tracks. An active mass is fixedly supported on a top face of the second support table. A second adjustable damping system is pivotally mounted between the plurality of second elongated tracks and the second support table for damping slidable movement of the second support table on the plurality of second elongated tracks.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 7:
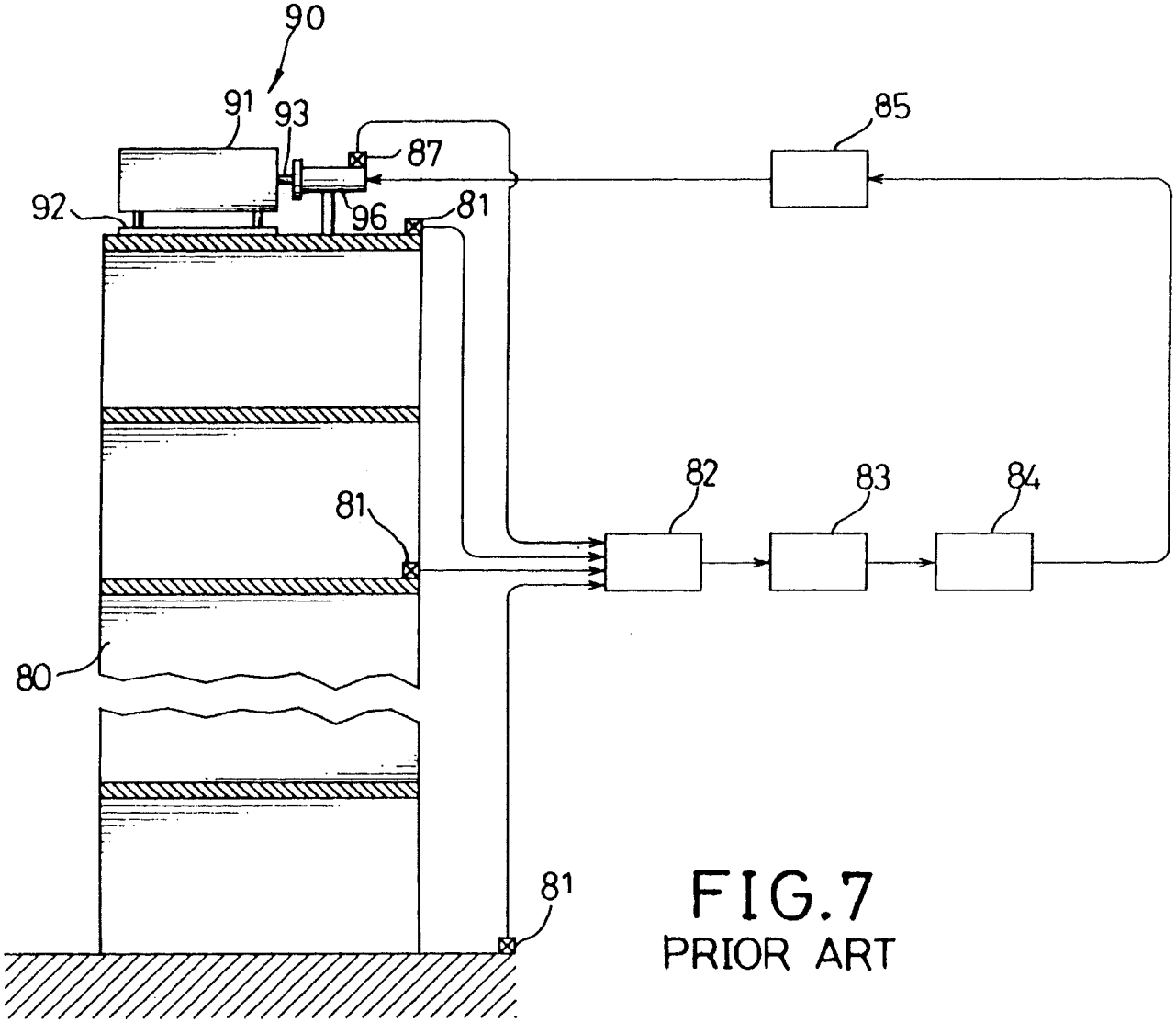
FIG.7 PRIOR ART
FIG. 7 is a schematic view of a vibration suppression device an accordance with the prior art.
Figure 8:
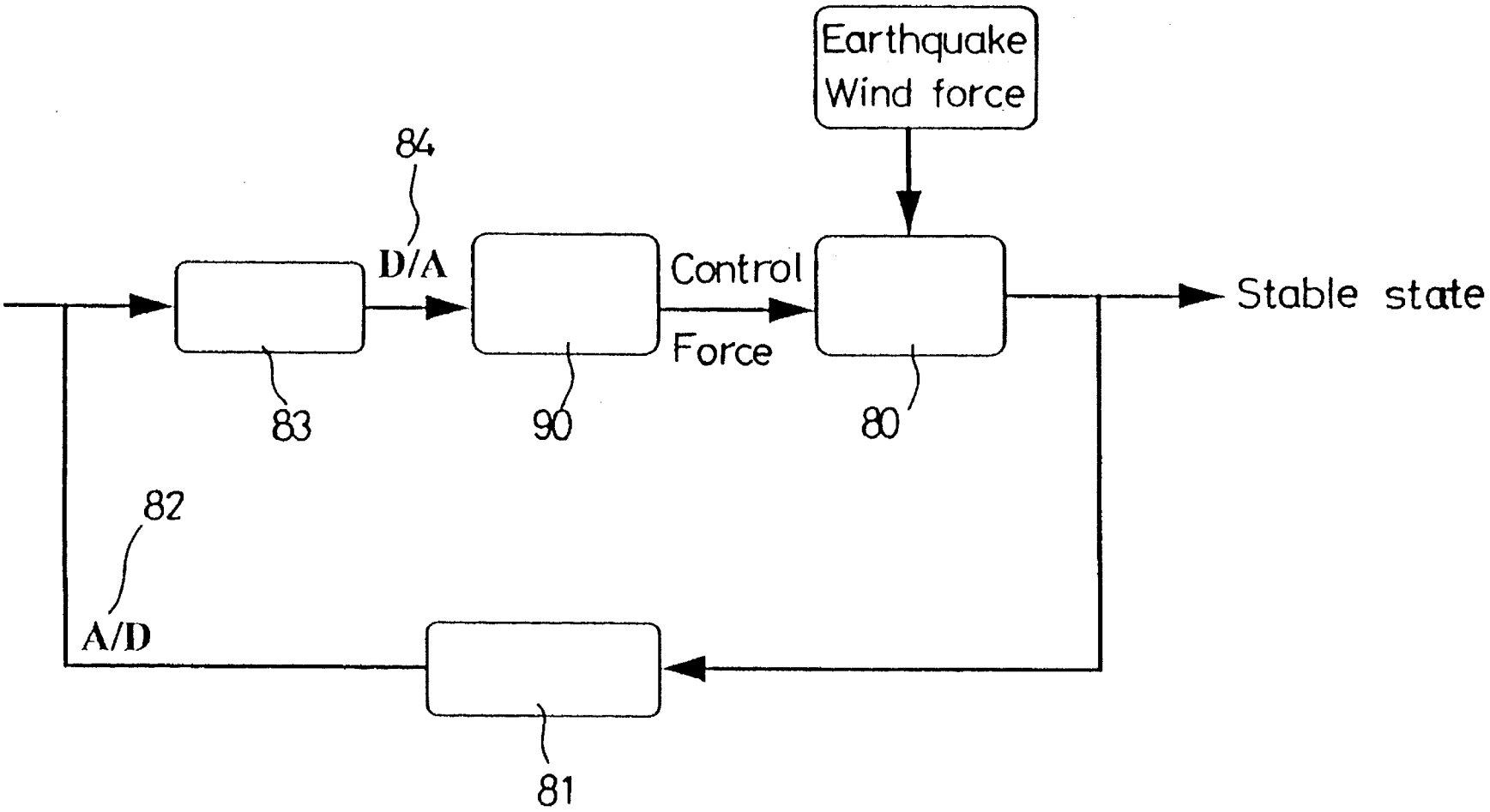
FIG. 8 PRIOR ART
FIG. 8 is a flow chart of the vibration suppression operation.

Referring to FIGS. 7 and 8, a conventional vibration suppression device 90 in accordance with the prior art is provided for a high-rise structure 80 (or building) and comprises a plurality of linear guides 92 fixedly mounted on a top face of the structure 80. An active mass 91 is slidably mounted on the linear guides 92 and is actuated to slide on the linear guides 92 freely by means of a ball screw 93 which is in turn driven by an alternating-current servo motor 96 mounted in an adjustable damping system (not shown) which is fixedly mounted on the top face of the structure 80 and includes a damper (not shown) and a spring (not shown) mounted therein.

A plurality of sensors 81 are respectively mounted in the structure 80 for detecting the acceleration, velocity, and displacement of different locations of the structure 80, thereby sending first analog signals to an analog/digital converter (A/D converter) 82 when a large vibration (or wobble) due to an earthquake or a blast of wind affecting the structure 80.

The A/D converter 82 can transform the first analog signals into first digital signals which are then in turn supplied into a central processing unit 83 which can perform an active control analysis and execute an operation synchronously, thereby deriving second digital signals which are in turn supplied to a digital/analog converter (D/A converter) 84 which can transform the second digital signals into second analog signals which are then supplied to a driver 85 (or motor actuating mechanism) which is able to drive the alternating-current servo motor 96 so as to move the active mass 91 via the ball screw 93 in a direction opposite to that of the movement of the structure 80, thereby suppressing vibration and oscillation of the structure 80.

An encoder 87 mounted on the alternating-current servo motor 96 can send analog signals to the A/D converter 82 which can transform the analog signals supplied from the encoder 87 and the sensors 81 into digital signals to be processed by means of the central processing unit 83 which can again operate the vibration suppression device 90 so as to eliminate the vibration effect of the structure 80 until a stable state is achieved to the structure 80.

The damper and spring of the adjustable damping system are able to provide a passive vibration suppression effect when the power supply is disrupted. In such a situation, the natural frequency and the damping value of the adjustable damping system must be equal to a first natural frequency of the structure 80 and an optimal damping value of a passive vibration damper, thereby providing an effective vibration suppression function.

However, there are shortcomings in the conventional vibration suppression device 90. Firstly, assume k is the elastic coefficient of the spring and M is the mass of the active mass 91. The natural frequency w of the adjustable damping system is derived in the following way: $w=\sqrt{(k/M)}$. In other words, the natural frequency w of the adjustable damping system is controlled by means of the elastic coefficient k of the spring.

Usually, k and M are both constants, therefore, the natural frequency w is also a constant such that the natural frequency w of the adjustable damping system can not be adjusted to be in concert with the first natural frequency of the structure 80, thereby greatly decreasing the vibration suppression effect.

In addition, the damper is used to buffer and remove energy created by the vibration of the structure 80. In the past years, Professor Den Harton has induced an optimal damping value of the passive vibration damper as follows:

$$D_{opt}=\sqrt{[3\mu/8(1+\mu)]}$$

Where $D_{opt}$ is the optimal damping value for the passive vibration damper, and $\mu$=(the active mass)/(the mass of the structure).

It is to be noted that, the damping value D of the adjustable damping system must be equal to the optimal damping value $D_{opt}$ of the passive vibration damper, thereby providing an excellent suppression effect. Therefore, it is important to adjust the damping value D of the adjustable damping system to be equal to the optimal damping value $D_{opt}$ of the passive vibration damper.

On the other hand, the damping value D of the adjustable damping system is controlled by the damping coefficient c of the damper. However, the damping coefficient c of the damper is always a constant such that the damping value D of the adjustable damping system can not be adjusted to be in concert with the optimal damping value $D_{opt}$ of the passive vibration damper, thereby greatly decreasing suppression effect of the adjustable damping system.

Further, the active mass 91 can only move along a single direction on the linear guides 92 such that the vibration suppression device 90 can perform the vibration suppression function along a single direction only, thereby limiting the applicability of the vibration suppression device 90 if the structure 80 vibrates two-dimensionally.

Moreover, a user has to equip the structure with a second vibration suppression device so as to perform the vibration suppression function two-dimensionally, thereby causing waste in available space and greatly increasing costs required for performing the vibration suppression function.

Figure 1:
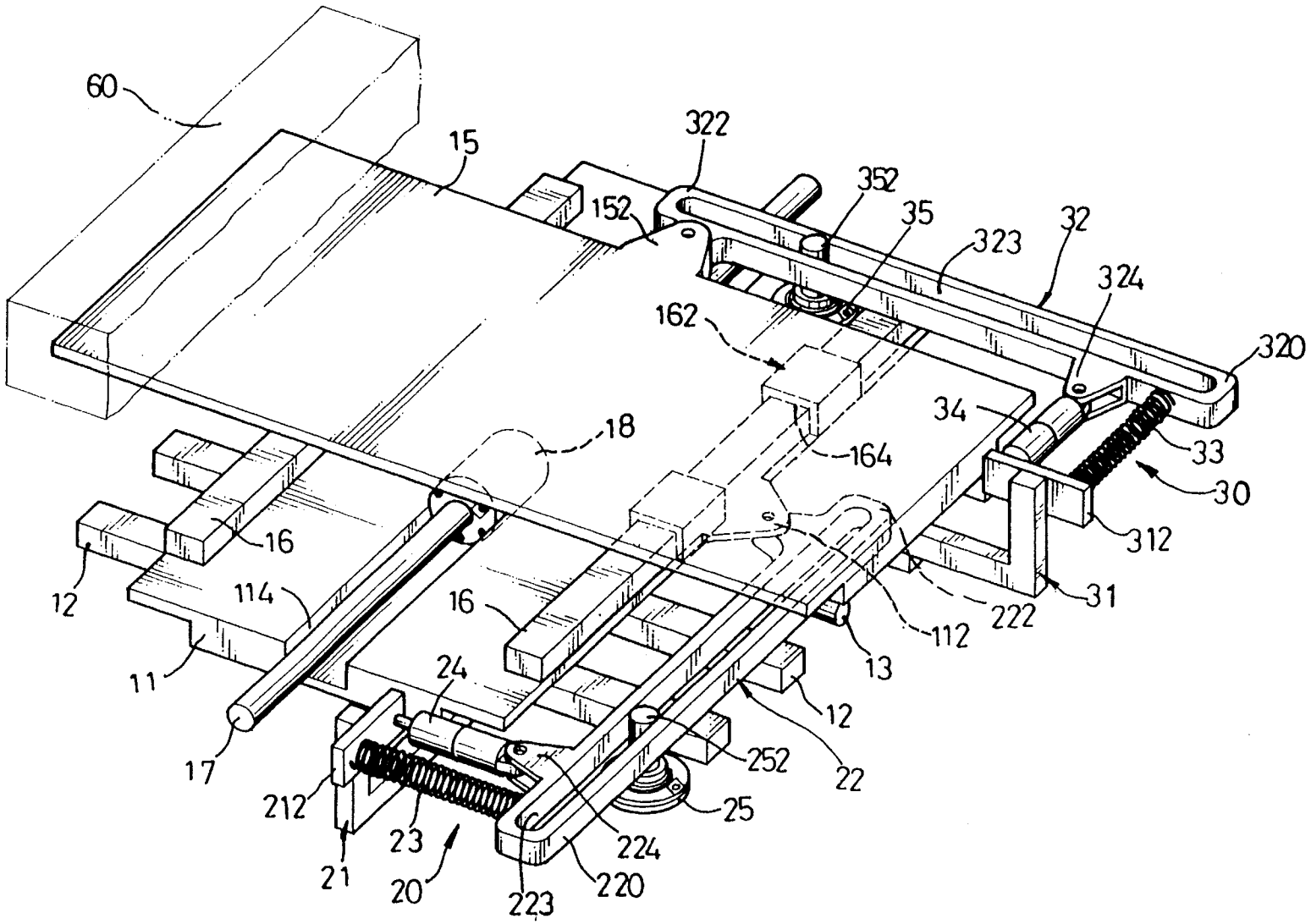
FIG. 1 is a perspective view of a vibration suppression device in accordance with the present invention.
Figure 2A:
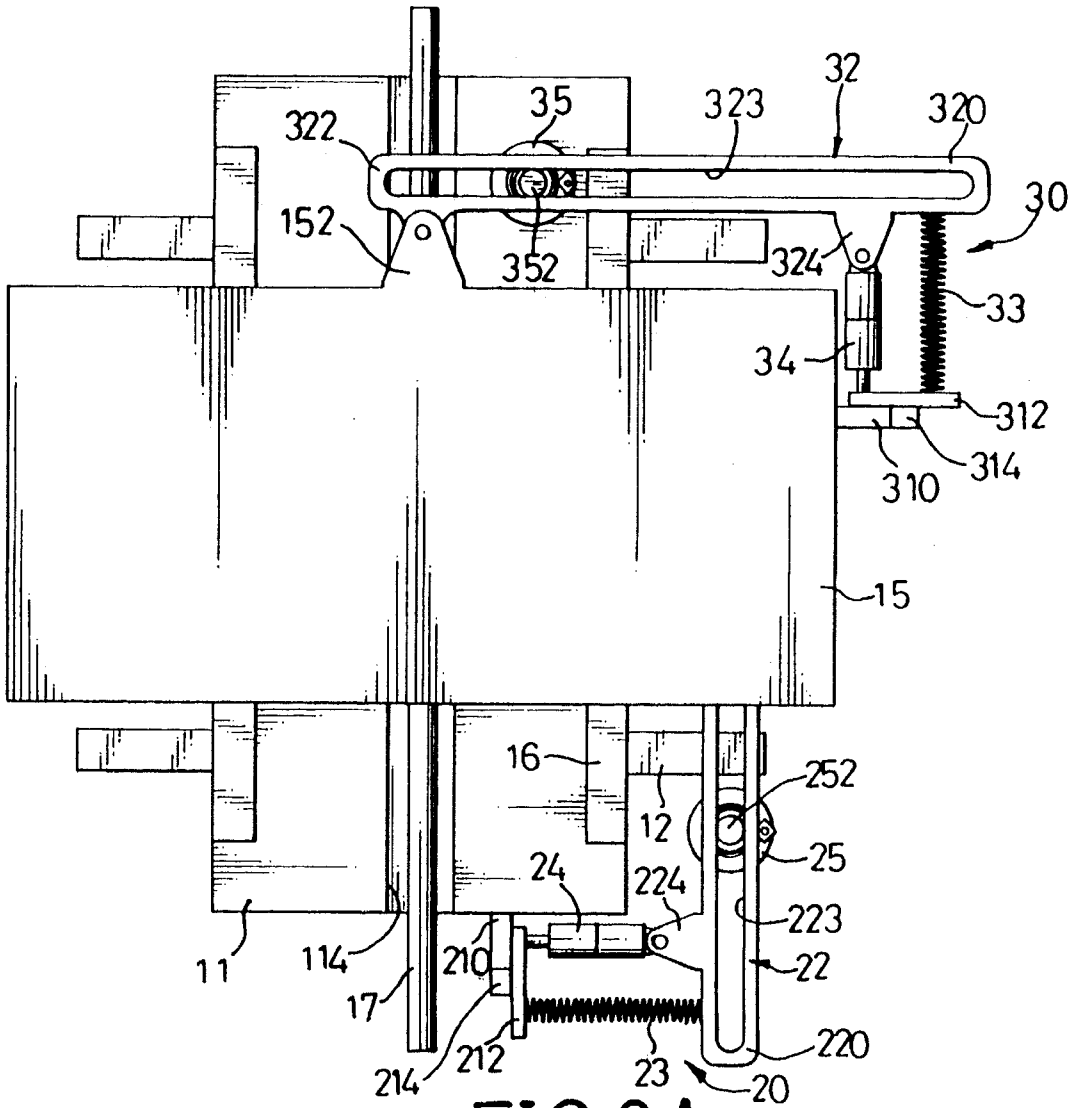
FIG. 2A is a top plan view of FIG. 1.
Figure 3:
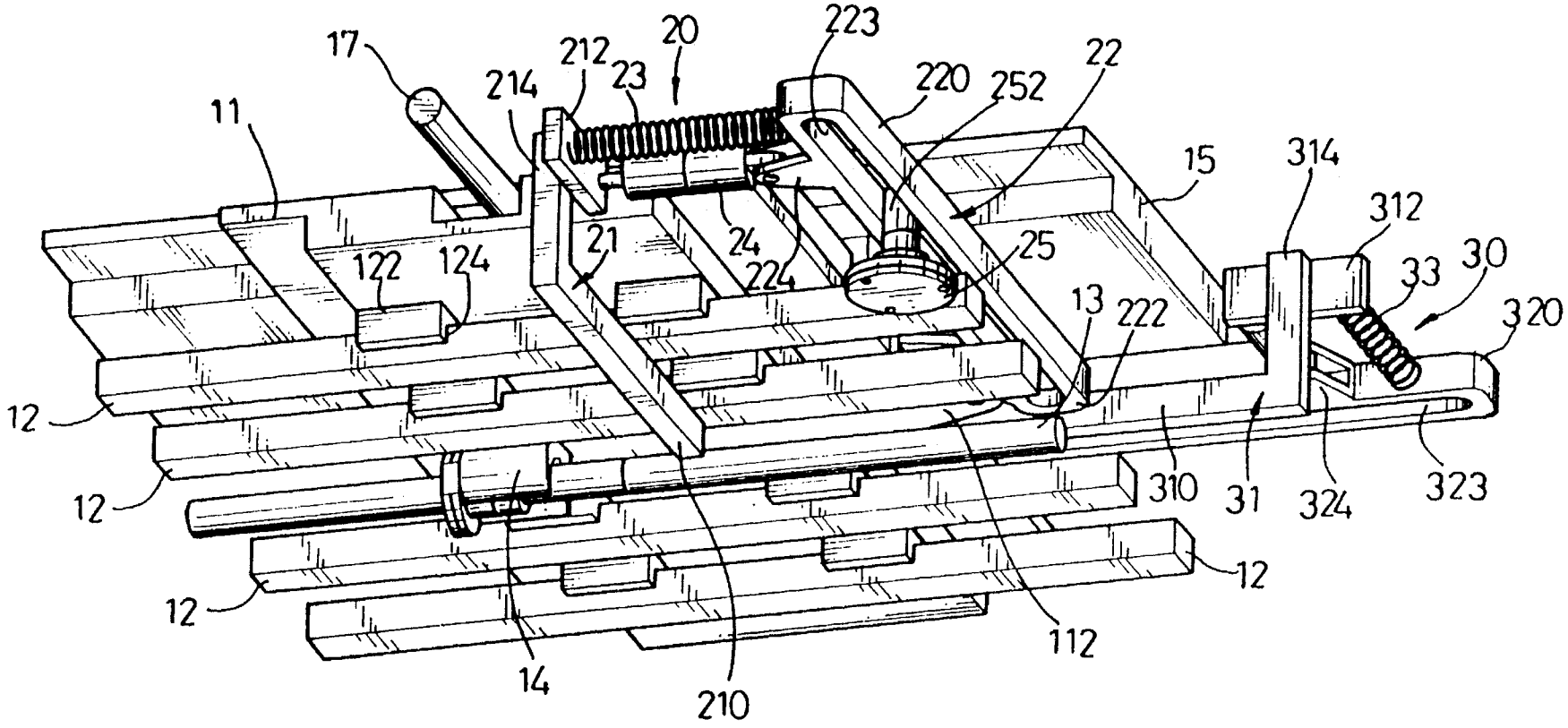
FIG. 3 is an inclined bottom perspective view of the vibration suppression device.

Referring to FIGS. 1, 2A and 3, a vibration suppression device in accordance with the present invention is provided for a high-rise structure or building and comprises four first elongated linear guides 12 fixedly mounted on a top face of the structure (not shown) and arranged in parallel with each other. A first support table 11 is slidably mounted on the plurality of first elongated linear guides 12.

A first adjustable damping system 20 is pivotally mounted between the plurality of first elongated linear guides 12 and the first support table 11 for damping slidable movement of the first support table 11 on the plurality of first elongated linear guides 12.

There are two second elongated linear guides 16 fixedly mounted on a top face of the first table 11 and arranged in parallel with each other and perpendicular to the plurality of first elongated linear guides 12. A second support table 15 is slidably mounted on the plurality of second elongated linear guides 16. An active mass 60 is fixedly supported on a top face of the second support table 15.

A second adjustable damping system 30 is pivotally mounted between the plurality of second elongated linear guides 16 and the second support table 15 for damping slidable movement of the second support table 15 on the plurality of second elongated linear guides 16.

Preferably, there are four pairs of substantially inverted U-shaped blocks 122 fixedly mounted on an underside of the first support table 11 and each having a recess 124 defined therein for slidably receiving a corresponding one of the four first elongated linear guides 12 such that the first support table 11 is able to slide on the plurality of first elongated linear guides 12 smoothly.

In addition, two pairs of substantially inverted U-shaped blocks 162 are fixedly mounted on an underside of the second support table 15 and each have a recess 164 defined therein for slidably receiving a corresponding one of the two first elongated linear guides 16 such that the second support table 15 is able to slide on the plurality of second elongated linear guides 16 smoothly.

A first ball screw 13 driven by a first alternating-current servo motor (not shown) is rotatably mounted under the first support table 11 in parallel with the first linear guides 12 and co-operates with a first nut 14 which is fixedly mounted on the underside of the first support table 11 so as to move the first support table 11 on the first linear guides 12 freely.

A second ball screw 17 driven by a second alternating-current servo motor (not shown) is rotatably mounted in an elongated groove 114 defined in the first support table 11 in parallel with the second linear guides 16 and co-operates with a second nut 18 which is fixedly mounted on the underside of the second support table 15 so as to move the second support table 15 on the second linear guides 16 freely.

The first support table 11 has an ear 112 laterally formed on one side thereof and horizontally protruding outwardly therefrom. The first adjustable damping system 20 comprises a substantially L-shaped positioning member 21 having a horizontal portion 210 fixedly attached to at least one of the plurality of first elongated linear guides 12 in a perpendicular fashion and a vertical portion 214 to which a coupling plate 212 is fixedly attached.

A damper 24 has a first end attached to the coupling plate 212 and a second end pivotally engaged with a first end 220 of an elongated linking lever 22 which has a second end 222 pivotally engaged with the ear 112 of the first support table 11. An elongated slot 223 is defined in the linking lever 22. Preferably, a pivot frame 224 is formed on the first end 220 of the linking lever 22 and is pivotally engaged with the second end of the damper 24.

An adjusting base 25 is fixedly mounted on the top face of the structure. An adjusting post 252 is fixedly formed on the adjusting base 25 and is received in the elongated slot 223 such that the linking lever 22 is able to pivot about the adjusting post 252. A biasing member 23, such as a spring, has a first end attached to the coupling plate 212 and a second end attached to the first end 220 of the linking lever 22.

The second support table 15 has an ear 152 laterally formed on one side thereof and horizontally protruding outwardly therefrom. The second adjustable damping system 30 comprises a substantially L-shaped positioning member 31 having a horizontal portion 310 fixedly attached to one of the plurality of second elongated linear guides 16 arranged in a perpendicular fashion and a vertical portion 314 to which a coupling plate 312 is fixedly attached.

A damper 34 has a first end attached the coupling plate 312 and a second end pivotally engaged with a first end 320 of an elongated linking lever 32 which has a second end 322 pivotally engaged with the ear 152 of the second support table 15. An elongated slot 323 is defined in the linking lever 32. Preferably, a pivot frame 324 is formed on the first end 320 of the linking lever 32 and is pivotally engaged with the second end of the damper 34.

An adjusting base 35 is fixedly mounted on the top face of the first support table 11. An adjusting post 352 is fixedly formed on the adjusting base 35 and is received in the elongated slot 323 such that the linking lever 32 is able to pivot about the adjusting post 352. A biasing member 33, such as a spring, has a first end attached to the coupling plate 312 and a second end attached to the first end 320 of the linking lever 32.

In operation, a plurality of sensors (not shown) mounted in the structure are able to send first analog signals to an A/D converter (not shown) when a large vibration (or wobble) due to an earthquake or a blast of wind affects to the structure.

The A/D converter can transform the first analog signals into first digital signals which is then supplied to a central processing unit (not shown) which can perform an active control analysis and execute operation synchronously, thereby deriving second digital signals which are subsequently supplied to a D/A converter (not shown) which can transform the second digital signals into second analog signals which are then supplied to a driver or a motor actuating mechanism (not shown).

The driver is able to drive the second alternating-current servo motor so as to move the second support table 15 on the second linear guides 16 by means of the second ball screw 17 and is able to drive the first alternating-current servo motor so as to move the first support table 11 together with the second support table 15 on the first linear guides 12 by means of the first ball screw 13 in a direction perpendicular to that of the second linear guides 16.

By the above-mentioned arrangement, the active mass 60 on the second support table 15 is able to move two-dimensionally. In other words, the active mass 60 is able to displace along the direction of the second linear guides 16 or the first linear guides 12 arbitrarily. Therefore, even if the structure may vibrate two-dimensionally, the active mass 60 is able to move in a direction opposite to that of the movement of the structure, thereby suppressing vibration and oscillation of the structure until a stable state is achieved.

The dampers 24 and 34 and the springs 23 and 33 of the adjustable damping systems 20 and 30 are able to provide a passive vibration suppression function when the power supply is disrupted. In such a situation, the natural frequency of the adjustable damping system 20 (or 30) must be equal to the first natural frequency of the structure, thereby providing an effective vibration suppression operation. In addition, the dampers 24 and 34 are used to buffer and dissipate energy created by the vibration of the structure.

Figure 4B:
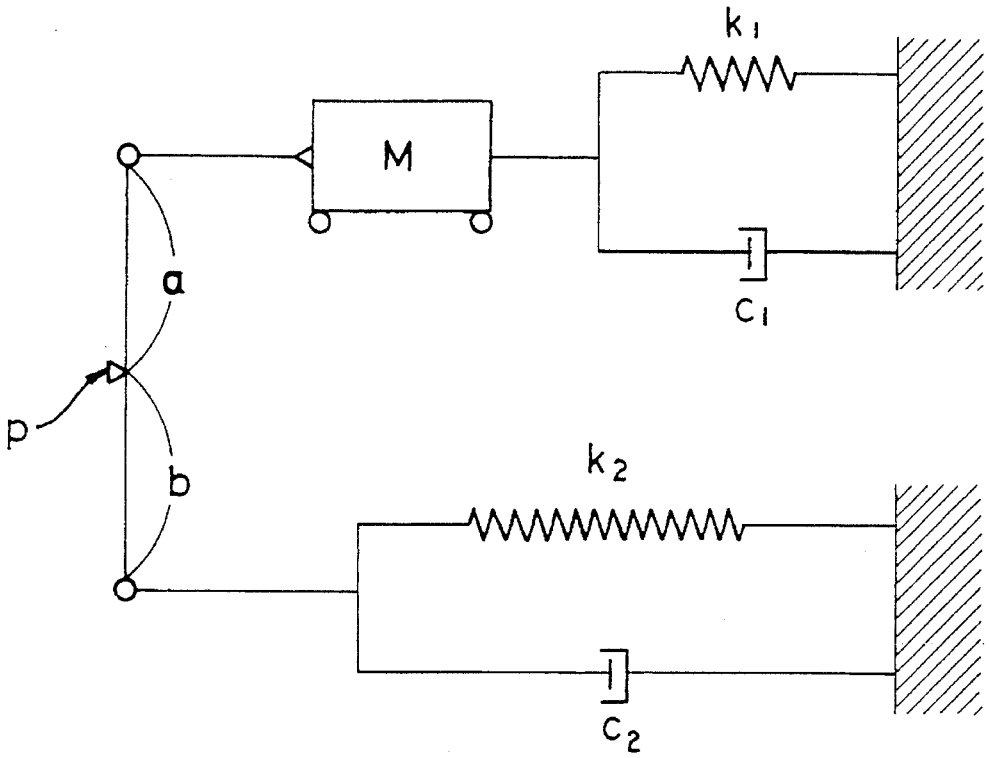
FIG. 4B is a schematic view showing an operation of a adjustable damping system in accordance with a second embodiment of the present invention.
Figure 4A:
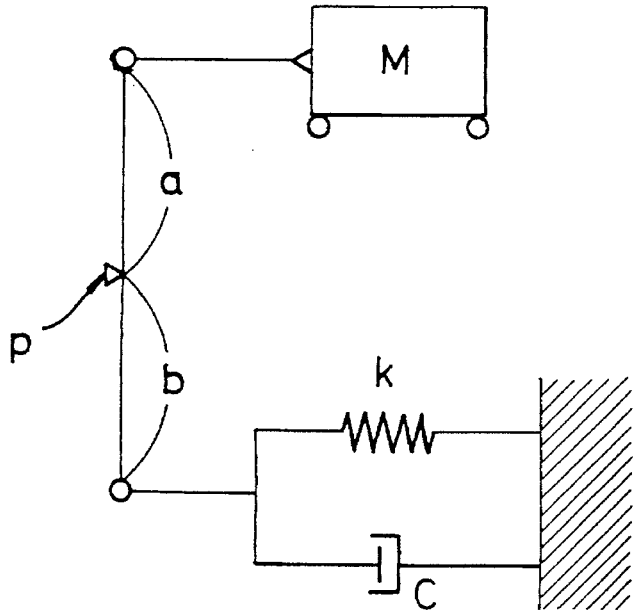
FIG. 4A is a schematic view showing an operation of a adjustable damping system.

Referring to FIG. 4A with reference to FIG. 2A, assume k is the elastic coefficient of the spring 23 (or 33), c is the damping coefficient of the damper 24 (or 34), M is a mass of the active mass 60 (see FIG. 1), p is a position of the adjusting post 252 (or 352), and a and b are respectively a distance between the adjusting post 252 (or 352) and two pivot points of the linking lever 22 (or 32). A governing equation of such a system is derived as follow:

$$M\,x''+(b^2/a^2)c\,x'+(b^2/a^2)k\,x=0,$$

where x is a displacement of the active mass.

The above equation can be simplified as follows:

$$x''+2D\,w\,x'+w^2\,x=0$$

wherein, $$(b^2/a^2)c/M=2D\,w,$$

and $$(b^2/a^2)k/M=w^2,$$

where D and w are respectively the modal damping value and the natural frequency of the adjustable damping system 20 (or 30).

From the above-mentioned equations, it can be found that the natural frequency w and the modal damping value D of the adjustable damping system 20 (or 30) are varied with the value of $(b^2/a^2)$ and are controlled just by adjusting a proportion between a and b. Therefore, it is apparent that, by adjusting the position of the adjusting post 252 (or 352), the natural frequency w and the modal damping value D of the adjustable damping system 20 (or 30) can be respectively adjusted to satisfy the first natural frequency of the structure and the optimal damping value $D_{opt}$ proposed by Professor Den Harton, thereby providing a great passive vibration suppression effect on the structure when the power supply is disrupted.

Figure 2B:
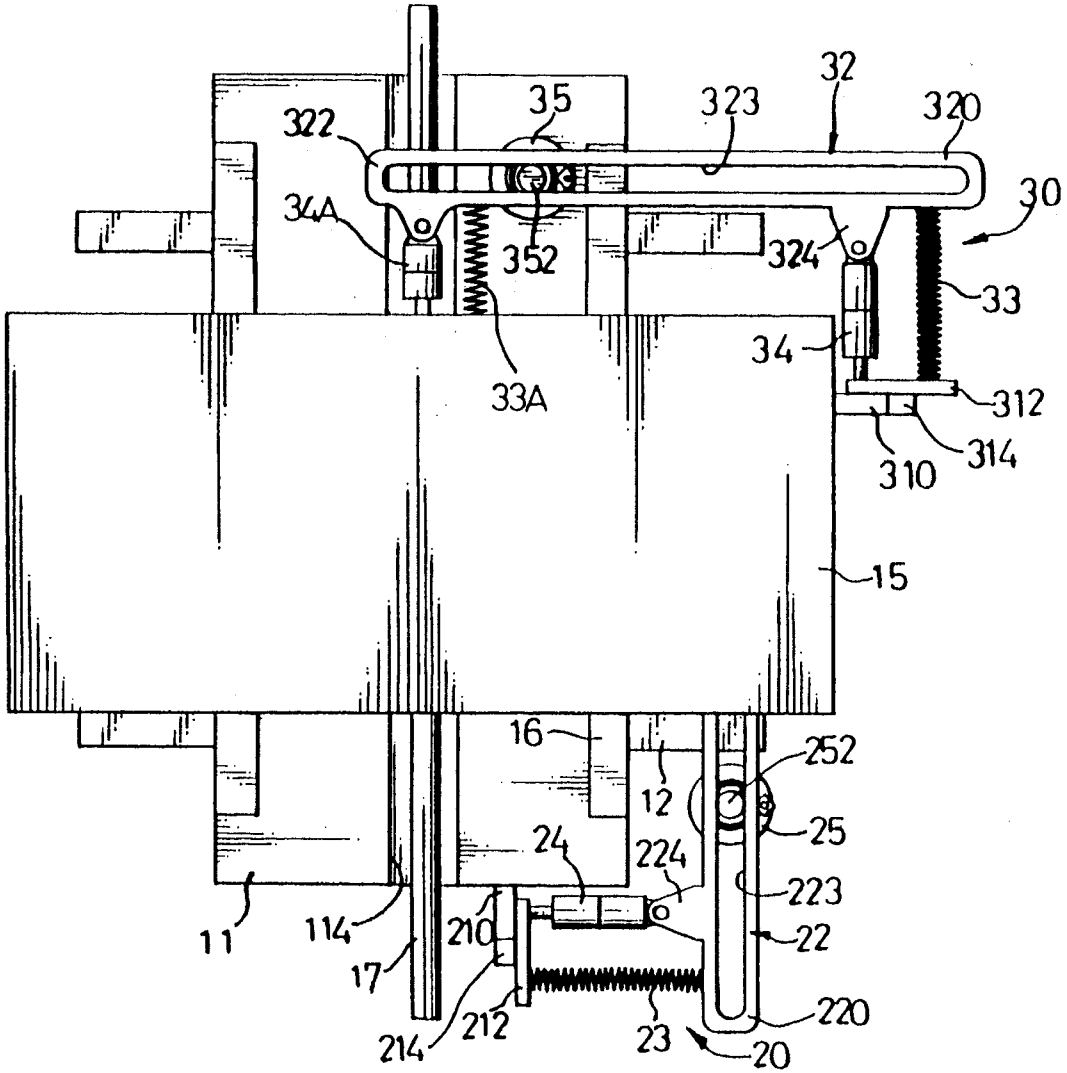
FIG. 2B is a top plan view of FIG. 1 in accordance with a second embodiment of the present invention.

Referring to FIG. 4B with reference to FIG. 2B, in accordance with another embodiment of the present invention, a spring 33A and a damper 34A are respectively mounted between the second end 322 of the linking lever 32 and one side of the second support table 15. Assume $k_1$ and $k_2$ are respectively the elastic coefficient of the springs 33A and 33, $c_1$ and $c_2$ are respectively the damping coefficient of the dampers 34A and 34, M is a mass of the active mass 60 (see FIG. 1), p is a position of the adjusting post 352, and a and b are respectively a distance between the adjusting post 352 and two pivot points of the linking lever 32. Then, a governing equation of such a system is derived in the following way:

$$Mx''+[c_1+c_2(b^2/a^2)]x'+[k_1+k_2(b^2/a^2)\,]x=0$$

The above equation can be simplified as follows:

$$x''+2D\,w\,x'+w^2x=0$$

wherein $$[c_1+c_2(b^2/a^2)]/M=2D\,w,$$

and $$[k_1+k_2(b^2/a^2)]/M=w^2$$

Where D and w are respectively the modal damping value and the natural frequency of the adjustable damping system 30.

From the above equations, it is apparent that, by adjusting the position of the adjusting post 352, the natural frequency w and the modal damping value D of the adjustable damping system 30 can be respectively adjusted to satisfy the first natural frequency of the structure and the optimal damping value $D_{opt}$ developed by Professor Den Harton.

Figure 5:
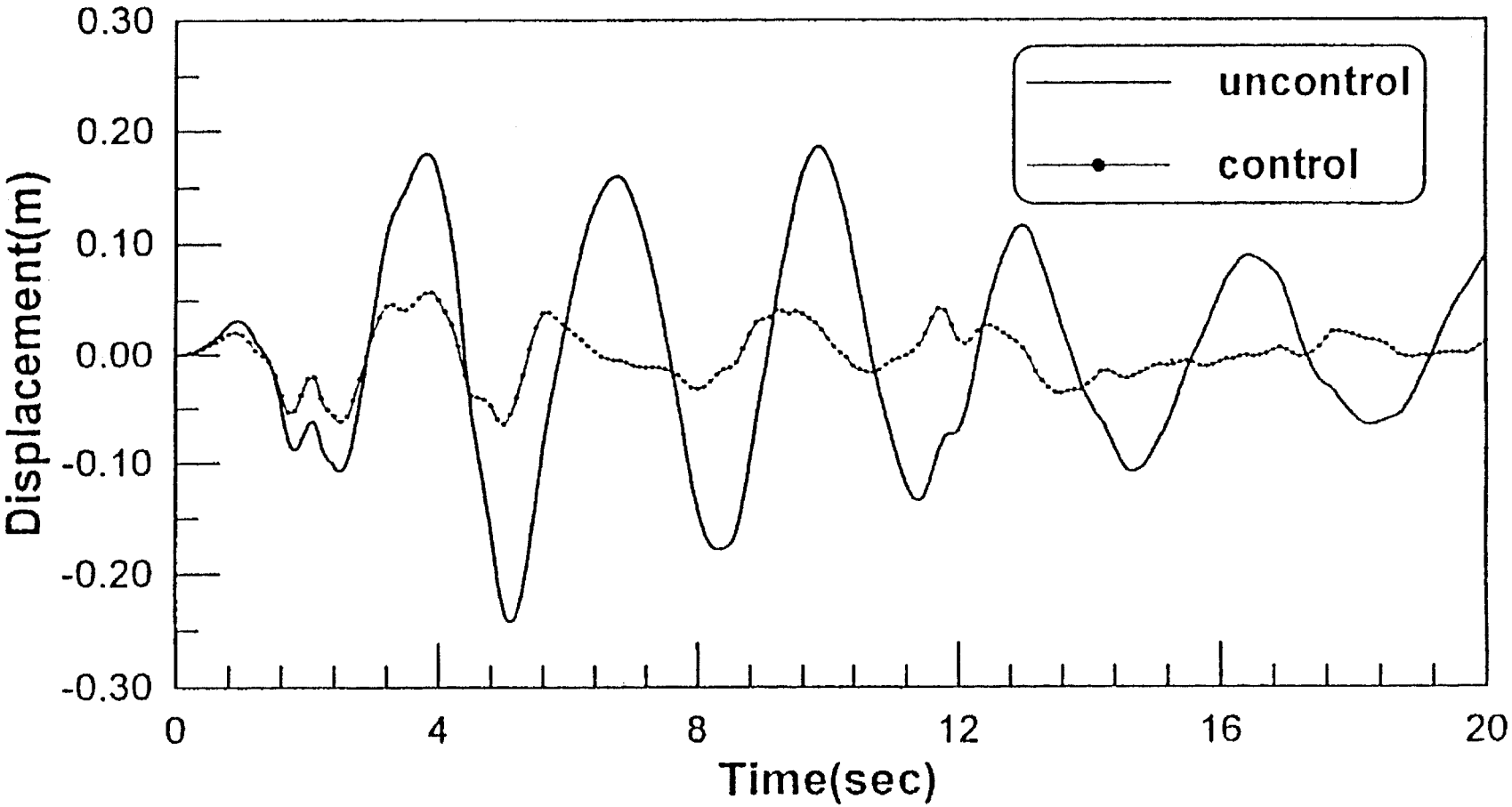
FIG. 5 is a graph showing a structure response under an influence of an earthquake.

Referring to FIG. 5, an experiment is made to a high-rise building or structure of forty-five floors which has endured an earthquake with a strength of six point seven in Richter Magnitude. In practice, assume the building weighs 47,000 tons with the length, width and height thereof equal to $57m*21m*162m*$? (meter) respectively. After executing a structural dynamic analysis, it is found that the first natural frequency of the structure is about 0.29 Hertzs, and the equal oscillating period of the structure is about 3.44 seconds.

It can be seen that, a maximum displacement of the top face of the structure reaches almost twenty-five centimeters as shown in solid lines when the structure is in an uncontrolled state. When the vibration suppression device of the present invention is provided, the displacement of the structure is controlled to a stable state rapidly as shown in phantom lines, thereby greatly eliminating the vibration phenomenon due to the earthquake.

Figure 6:
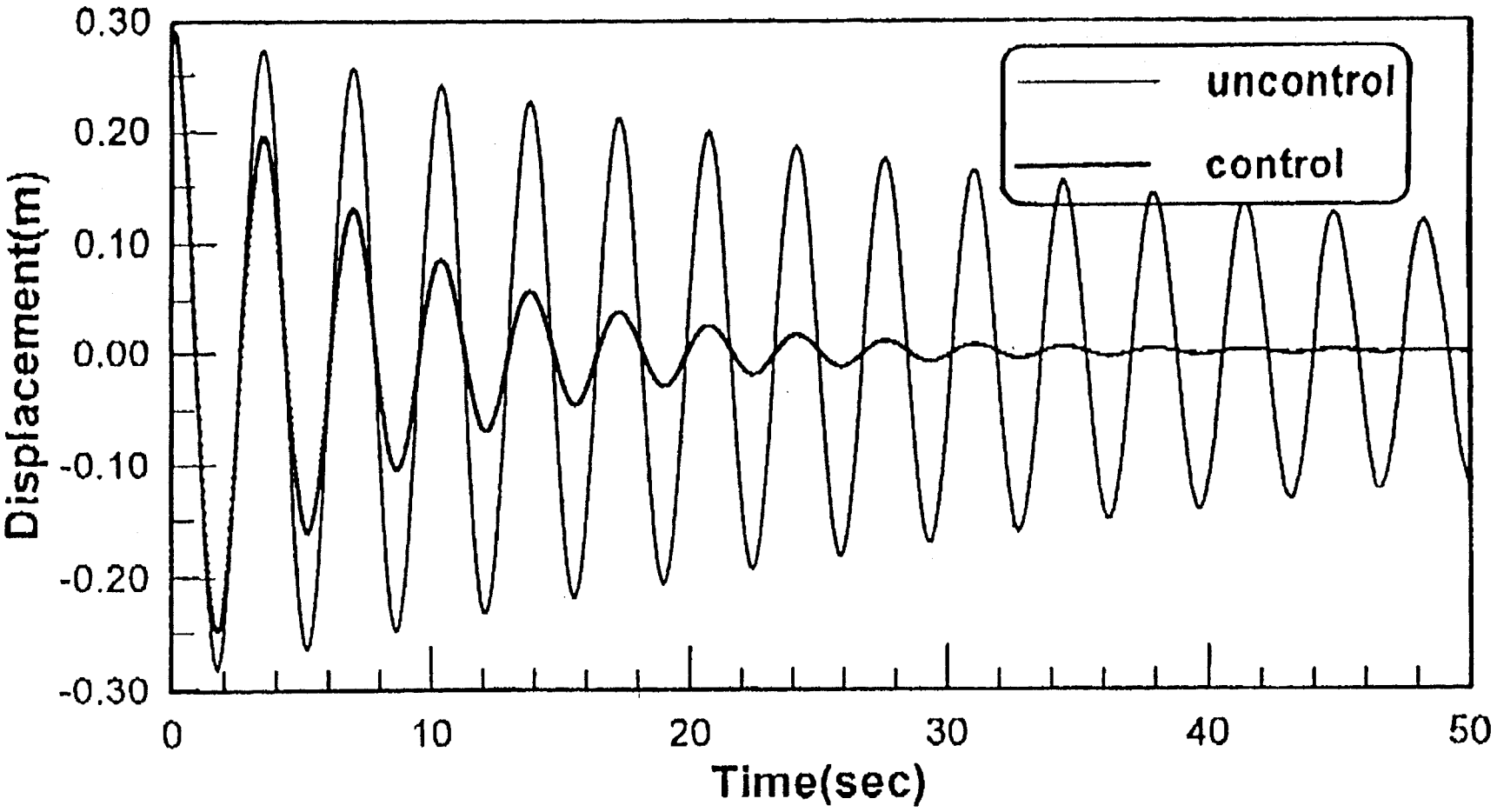
FIG. 6 is a graph showing a structure response under an influence of a blast of wind.

Referring to FIG. 6, a blast of wind is exerted on the same high-rise structure. After exerting a fifty-year recursive period action with a ten-minute average wind velocity on the structure, it can be seen that, a maximum displacement of the top face of the structure reaches almost twenty-nine centimeters as shown in solid lines when the structure is in an uncontrolled state. When the vibration suppression device of the present invention is applied, the displacement of the top face of the structure is controlled to a steady and stable state rapidly as shown in bold solid lines, thereby greatly eliminating the vibration phenomenon due to the blast of wind.

Accordingly, a vibration suppression device in accordance with the present invention has the following advantages and benefits:

(1) The present invention can provide a vibration suppression function in a two-dimensional manner, thereby providing an excellent active vibration suppression effect on the structure.

(2) The natural frequency and the modal damping value of the adjustable damping system are adjustable so as to satisfy the first natural frequency of the structure and the optimal damping value, thereby providing an excellent passive vibration suppression effect on the structure.

It should be clear to those skilled in the art that further embodiments of the present invention may be made without departing from the teachings of the present invention.

What is claimed is:

1. A vibration suppression device for a structure which has a top face, said vibration suppression device comprising:

a plurality of first elongated linear guides (12) fixedly mounted on the top face of said structure and arranged in parallel with each other;

a first support table (11) slidably mounted on said plurality of first elongated linear guides (12);

a first adjustable damping system (20) pivotally mounted between said plurality of first elongated linear guides (12) and said first support table (11) for damping slidable movement of said first support table (11) on said plurality of first elongated linear guides (12);

a plurality of second elongated linear guides (16) fixedly mounted on a top face of said first table (11) and arranged in parallel with each other and perpendicular to said plurality of first elongated linear guides (12);

a second support table (15) slidably mounted on said plurality of second elongated linear guides (16), an active mass (60) fixedly supported on a top face of said second support table (15);

a second adjustable damping system (30) pivotally mounted between said plurality of second elongated linear guides (16) and said second support table (15) for damping slidable movement of said second support table (15) on said plurality of second elongated linear guides (16).

2. The vibration suppression device in accordance with claim 1, wherein said first support table (11) has an ear (112) laterally formed thereon and horizontally protruding outwardly therefrom, said first adjustable damping system (20) comprises a substantially L-shaped positioning member (21) having a horizontal portion (210) fixedly attached to at least one of said plurality of first elongated linear guides (12) in a perpendicular fashion and a vertical portion (214), a coupling plate (212) fixedly attached to the vertical portion (214) of said positioning member (21), a damper (24) having a first end attached said coupling plate (212) and a second end, a linking lever (22) having a first end (220) pivotally engaged with the second end of said damper (24) and a second end (222) pivotally engaged with said ear (112) of said first support table (11), an elongated slot (223) defined in said linking lever (22), an adjusting base (25) fixedly mounted on the top face of said structure, an adjusting post (252) formed on said adjusting base (25) and received in said elongated slot (223) of said linking lever (22), and a biasing member (23) having a first end attached to said coupling plate (212) and a second end attached to the first end (220) of said linking lever (22).

3. The vibration suppression device in accordance with claim 1, wherein said second support table (15) has an ear (152) laterally formed thereon and horizontally protruding outwardly therefrom, said second adjustable damping system (30) comprises a substantially L-shaped positioning member (31) having a horizontal portion (310) fixedly attached to at least one of said plurality of second elongated linear guides (16) in a perpendicular fashion and a vertical portion (314), a coupling plate (312) fixedly attached to the vertical portion (314) of said positioning member (31), a damper (34) having a first end attached said coupling plate (312) and a second end, a linking lever (32) having a first end (320) pivotally engaged with the second end of said damper (34) and a second end (322) pivotally engaged with said ear (152) of said second support table (15), an elongated slot (323) defined in said linking lever (32), an adjusting base (35) fixedly mounted on the top face of said first support table (11), an adjusting post (352) formed on said adjusting base (35) and received in said elongated slot (323) of said linking lever (32), and a biasing member (33) having a first end attached to said coupling plate (312) and a second end attached to the first end (320) of said linking lever (32).

* * * * *